US010510223B2

(12) United States Patent
Rizk

(10) Patent No.: US 10,510,223 B2
(45) Date of Patent: Dec. 17, 2019

(54) DURABLE SIGNALING, CUSTOMIZABLE ILLUMINATION DEVICE

(71) Applicant: Mark Rizk, Markham (CA)

(72) Inventor: Mark Rizk, Markham (CA)

( * ) Notice: Subject to any disclaimer, the term of this patent is extended or adjusted under 35 U.S.C. 154(b) by 0 days.

(21) Appl. No.: 15/963,099

(22) Filed: Apr. 26, 2018

(65) Prior Publication Data

US 2019/0206198 A1 Jul. 4, 2019

Related U.S. Application Data

(60) Provisional application No. 62/613,200, filed on Jan. 3, 2018.

(51) Int. Cl.

| | |
|---|---|
| ***G08B 5/38*** | (2006.01) |
| ***F21S 9/02*** | (2006.01) |
| ***F21L 4/02*** | (2006.01) |
| ***F21V 23/00*** | (2015.01) |
| *F21Y 115/00* | (2016.01) |
| *H05B 33/08* | (2006.01) |

(52) U.S. Cl.

CPC ..... *G08B 5/38* (2013.01); *F21L 4/027* (2013.01); *F21S 9/022* (2013.01); *F21V 23/005* (2013.01); *F21Y 2115/00* (2016.08); *H05B 33/0803* (2013.01)

(58) Field of Classification Search

CPC combination set(s) only.

See application file for complete search history.

(56) References Cited

U.S. PATENT DOCUMENTS

| | | | | |
|---|---|---|---|---|
| 5,418,334 | A * | 5/1995 | Williams | H04L 43/00 178/1 |
| 5,685,631 | A * | 11/1997 | Dobert | F21V 21/096 362/158 |
| 6,086,220 | A * | 7/2000 | Lash | B60Q 1/2611 340/815.45 |
| 2002/0003697 | A1* | 1/2002 | Chien | F21V 21/0824 362/84 |
| 2002/0167415 | A1* | 11/2002 | Rains | A63C 17/01 340/665 |
| 2005/0018435 | A1* | 1/2005 | Selkee | F21L 4/02 362/427 |
| 2008/0106430 | A1* | 5/2008 | Yeh | F21V 19/0055 340/815.73 |
| 2008/0247161 | A1* | 10/2008 | Hulsey | B63B 45/04 362/227 |

(Continued)

*Primary Examiner* — Travis R Hunnings

(74) *Attorney, Agent, or Firm* — Chumak & Company LLP; Yuri Chumak

(57) ABSTRACT

A signaling/illumination device includes a first and a second potentiometer, configured to enable modulation of at least one Chip on Board LED. The first potentiometer controls the light intensity of the at least one of the Chip on Board LED. The second potentiometer controls the pulse width modulation/strobing of the at least one Chip on Board LED. The device includes a polycarbonate/poly-resin housing with substantially cylindrical exterior profile for attachment to the first and the second potentiometers and a circuit and a power source embedded within the housing for powering the first and the second potentiometers. At least one electrical connection from the circuit and the power source is embedded in the housing and exposed for connection to an external charging source.

7 Claims, 3 Drawing Sheets

(56) References Cited

U.S. PATENT DOCUMENTS

| | | | | |
|---|---|---|---|---|
| 2010/0328946 | A1* | 12/2010 | Borkar | H05B 33/0845 362/249.02 |
| 2012/0020061 | A1* | 1/2012 | Schefers | E02B 3/20 362/183 |
| 2014/0055054 | A1* | 2/2014 | Borkar | H05B 33/0845 315/210 |
| 2015/0251735 | A1* | 9/2015 | O'Maley, Jr. | B63B 45/04 362/477 |
| 2015/0305108 | A1* | 10/2015 | Probasco | A01G 22/00 47/58.1 LS |
| 2017/0086271 | A1* | 3/2017 | Borkar | H05B 33/0845 |
| 2017/0151989 | A1* | 6/2017 | Daniels | B62J 6/005 |

* cited by examiner

DURABLE SIGNALING, CUSTOMIZABLE ILLUMINATION DEVICE

FIELD OF TECHNOLOGY

The present specification is directed to devices for signaling and illuminating a specific environment.

BACKGROUND

A vast number of devices in the safety industry function as illumination and/or signaling devices, such as electronic flares, incendiary flares, smoke signals, etc. However, numerous deficiencies are found within these existing devices.

For one, devices such as electronic flares, which primarily used red LEDs (singular diode LEDs), often provide inadequate visibility in nighttime scenarios, and are even more difficult to spot in daytime environments. Incendiary flares are primarily visible in nighttime settings and are nearly invisible in daytime settings.

Furthermore, many existing electronic flares provide a singular light intensity setting, along with a limited number of lighting patterns. These flares typically limit the user to use of the flare in a specific scenario and restrict users (police officers, fire fighters, paramedics) from altering the light or strobe settings for use in different environments.

Moreover, incendiary flares and/or smoke signals can be extinguished by running any kind of vehicle over the signaling source. Often, they cannot endure severe usage cases and offer low durability.

As well, the amount of visible light emitted from the incendiary flares can be low compared to the amount of energy wasted on the extreme heat created.

And, smoke signals and incendiary flares comprise harmful chemicals and fumes that when burned or ignited, creating carcinogens that can cause or contribute to health problems to the user or any bystanders, particularly after repeated exposure.

Improvements in signaling and illumination devices are desirable.

The preceding examples of the related art and limitations related to it are intended to be illustrative and not exclusive. Other limitations of the related art will become apparent to those of skill in the art upon a reading of the specification and a review of the drawings.

BRIEF DESCRIPTION OF THE DRAWINGS

The described embodiments may be better understood by reference to the following description and the accompanying drawings. Additionally, advantages of the described embodiments may be better understood by reference to the following description and accompanying drawings.

DETAILED DESCRIPTION

Figure 1:
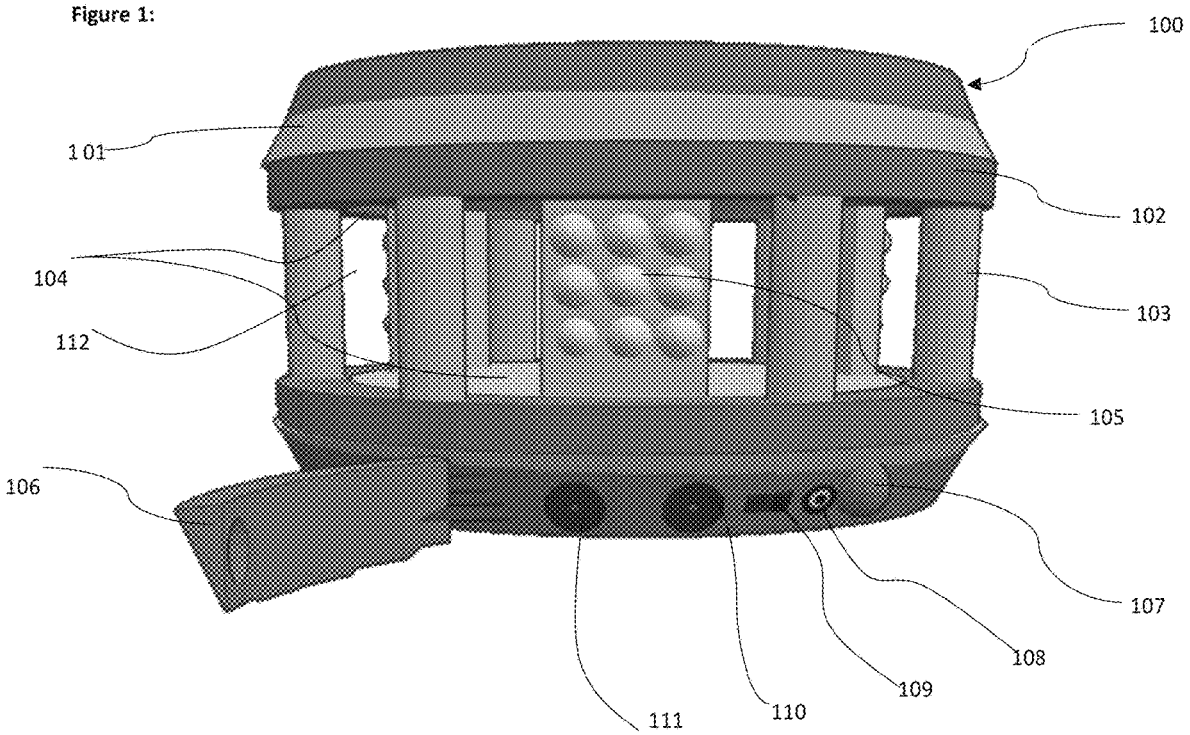
FIG. 1 is a front perspective view of an illumination/signaling device in accordance with a first example.

Representative apparatuses according to the present application are described in this section. These examples are being provided solely to add context and aid in the understanding of the described embodiments. It will thus be apparent to one skilled in the art that the described embodiments may be practiced without some or all these specific details. In other instances, well-known features have not been described in detail to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the scope of the described embodiments.

The following describes an exemplary signaling/illumination device that includes a first and a second potentiometer, configured to enable modulation of at least one Chip on Board LED. The first potentiometer controls the light intensity of the at least one of the Chip on Board LED. The second potentiometer controls the pulse width modulation/strobing of the at least one Chip on Board LED. The device includes a polycarbonate/poly-resin housing with substantially cylindrical exterior profile for attachment to the first and the second potentiometers and a circuit and a power source embedded within the housing for powering the first and the second potentiometers. At least one electrical connection from the circuit and the power source is embedded in the housing and exposed for connection to an external charging source.

The following further describes an exemplary signaling/illumination device including: a cylindrical shape with a plurality of surfaces, which can be situated upon numerous surfaces or attached on the top and bottom surfaces. At least one Chip on Board light emitting diode within the housing, where when situated on a surface at either the top or bottom side of the device, light from the at least one Chip on Board light emitting diode emits through the omnidirectional transparent surface in the middle of the device. The device can be readily deployed and function in many surfaces and/or environments. Rechargeable batteries allow multiple uses of the device. This device can also emit light for extensive durations of time and features improved durability. The reflective material surrounding different components of the device allows for more visibility and attention to the area or environment the device is placed in. This waterproof, rugged device is equipped with handling various scenarios, such as marine applications, construction sites, roadside assistance, and so on.

FIG. 1 illustrates a front perspective view of a first example of an illumination/signaling device in accordance with the present specification. The device 100 includes a polycarbonate/poly-resin plastic outer housing 102 with a rubber coating. In one example, the rubber coating may be thick for improved grip. The outer housing 102 includes a durable plastic window 112 through which the Chip on Board LED 105 emit light. Multiple Chip on Board LEDs 105 may be used as an alternative to regular singular diode LEDs because of their higher efficiency rating, and also allowing for more intense light to be emitted. An epoxy layer on top of the board of the Chip on Board LEDs 105 may spread out the beams of light more effectively, compared to the single direction of light from regular singular diode LEDs. The outer housing 102 includes retro reflective material 101 to assist with the visibility of device 100 as it reflects the light pointing towards the device. Material 101 allows the device to be more visible when Chip on Board LED 105 *s* are off and or device 100 has a low battery charge. A flexible rubber cover 106 and a round stud 107 function together to protect the device 100 from external fluids from entering the device's circuitry. They also allow the device 100 to be waterproof and sand/dust proof, which increases durability and reliability. Potentiometers 110 and 111 allow the device 100 to become significantly more customizable and adaptable to virtually any environment the device is deployed. The potentiometer 110 controls the pulse width modulation/strobing of the Chip on Board LED 105 and the potentiometer 111 controls the light intensity of the Chip on Board LEDs 105. The aluminum reflective surface 104 acts as an assist to the distribution of the light emitted from the Chip on Board LEDs 105 to allow the light to point upwards and downwards instead of pointing around the sides of the device 100. The toggle on and off switch 109 controls the Chip on Board LEDs 113 on the top surface of the 100 device. The device 100 is comprised of a charging port 108 to recharge the batteries in the circuit enclosed in the polycarbonate/poly-resin plastic outer housing 102.

Figure 2:
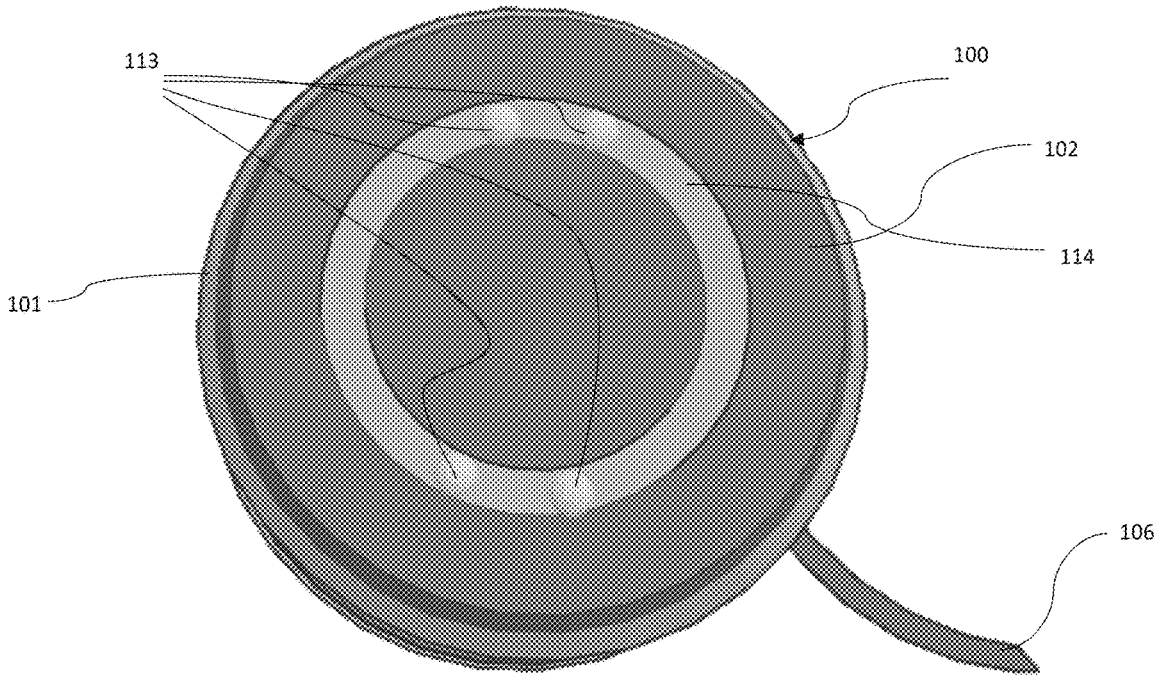
FIG. 2 is a top perspective view of the illumination/signaling device of FIG. 1.

FIG. 2 illustrates a top perspective view of the device of FIG. 1. The Chip on Board LEDs 113 are enclosed in durable plastic windows. The Chip on Board LEDs 113 allows for users such as police officers to use the device 100 as an optional flashlight in alternative situations such as on-foot patrols or investigations. The retro reflective material 114 is printed on the top surface of the device 100 in a circular shape to match the device's top surface shape; the retro reflective material 114 functions as a reflector to external light shining on the device 100 and this increases the overall visibility of the device 100 from higher vantage points. This top surface of device 100 may be useful for notifying further drivers or civilians of the highlighted area.

Figure 3:
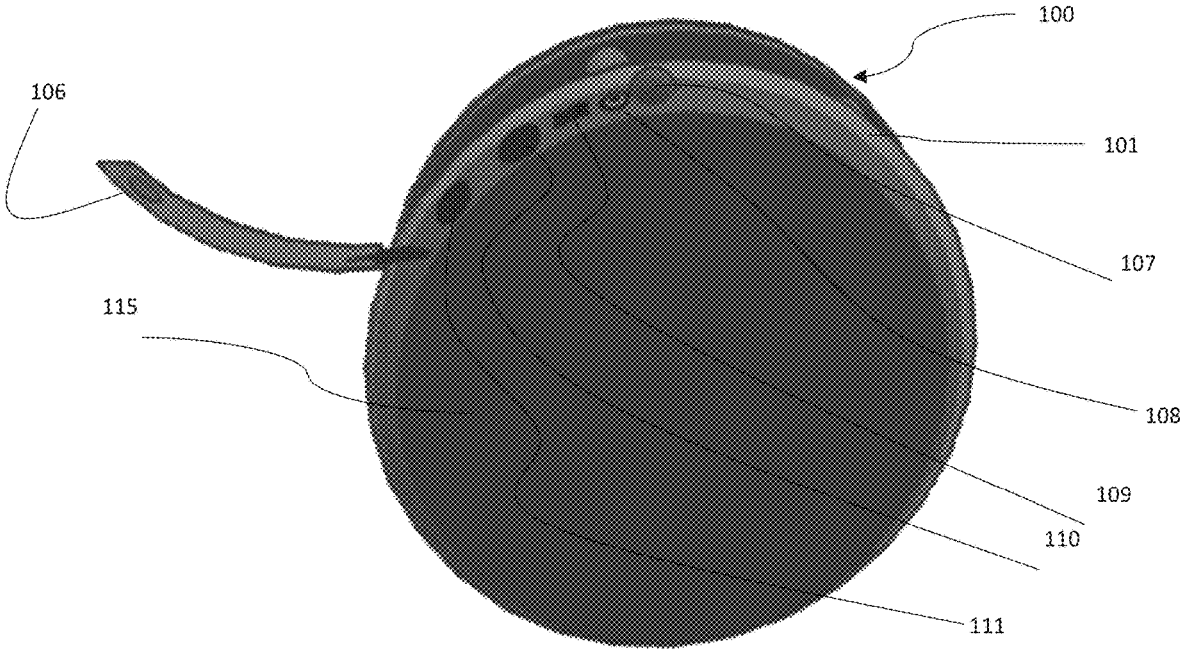
FIG. 3 is a bottom perspective view of the illumination/signaling device of FIG. 1.

FIG. 3 illustrates a perspective bottom view of the device of FIG. 1. A magnetic base 115 on the bottom surface of device 100 provides the user with the option to attach a handle/tripod 200 to the bottom of the device 100, allowing the device 100 to be set upon more rough terrain or uneven roads. Another use for the magnetic base 115 is to open options on which surface the device 100 can deployed on, such as a police cruiser, disabled car on the side of a road, street sign, etc.

Figure 4:
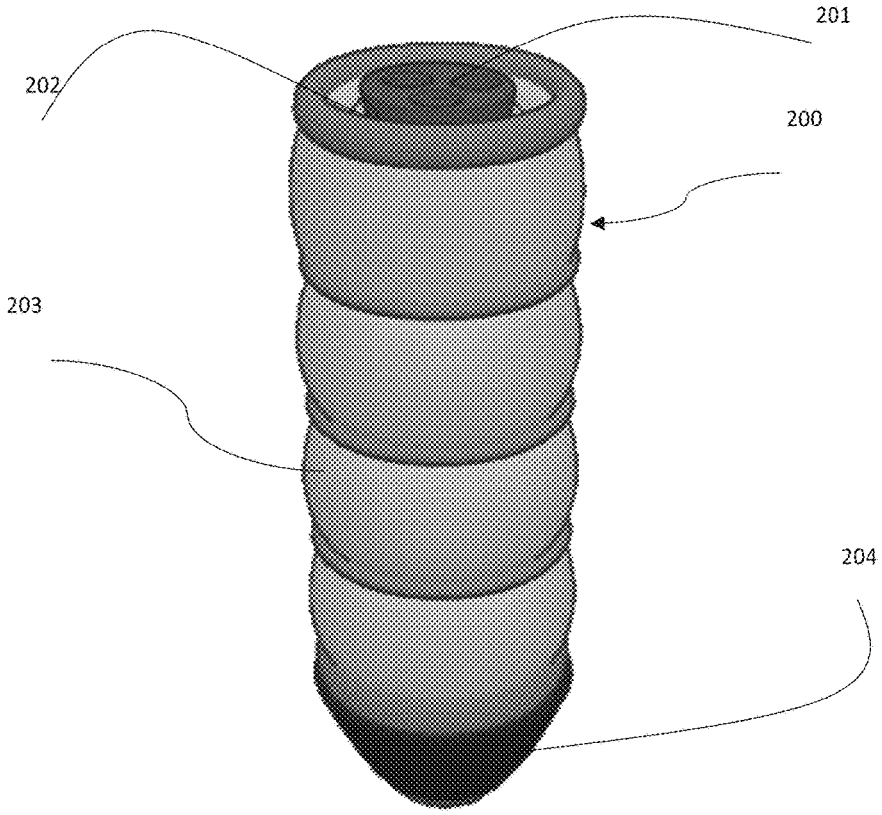
FIG. 4 is a perspective view of an example handle attachment for use with the illumination/signaling device of FIG. 1.

FIG. 4 is a perspective view of an exemplary handle attachment for use with the illumination/signaling device of FIG. 1 in accordance with the present specification. The handle 200 is a hybrid of two functions; using the foam grip 203 for hand held use of the device 100 can be employed in situations that demand so, such as guiding traffic, directing civilians, and so on. The second function is as a handle/tripod stand using the four way handle/tripod mechanism 202 attached to four legs to allow the device 100 to be deployed in a plurality of surfaces/environments, such as uneven roads, uneasy terrain, and so on. The magnetic surface 201 acts as the tether between device 100 and the handle 200 when functioning together, and at least one of the magnetic surfaces hold contact with the other surface. The rubber cap cover 204 for the handle's legs offer increased durability to the legs of the handle/tripod when deployed on harsh surfaces. The rubber cap cover 204 also acts as a high friction surface when in contact with surfaces that allows the device 100 to remain set at the same area it was previously deployed in, and resists any natural forces such as heavy wind or gust that may push the device 100 over.

The potentiometer 110 (controlling the strobe/pulse width modulation of the Chip on Board LED's) and the potentiometer 111 (controlling the brightness of the Chip on Board LED's) offers accurate control compared to the previous approaches. Providing the user increased customizability and allows for diverse use cases of the device 100.

In addition to the high degree of customizability, in one example, three Chip on Board LEDs 105 can be arranged and evenly separated on the aluminum reflective surface. The Chip on Board LEDs 105 may be more efficient than the traditional LEDs used in previous devices in this field; the Chip on Board LEDs 105 can be selected to be efficient in terms of light distribution and energy consumption.

In addition to the Chip on Board LEDs 105, the use of retro reflective material increases the visibility of the device without the excessive use of the device's power source; allowing the more efficient use of the device's electrical energy along with a more cost effective design.

In accordance with one example, enclosing the device 100 is a rugged polycarbonate/poly-resin housing. This housing may be covered with a dense rubber coating in order to endure shock and or other environmental challenges. The housing provides the signaling/illumination device with a cylindrical exterior profile; this assists the user in terms of easy deployment on any surface, and ergonomically friendly design. The omnidirectional plastic compartment that covers the Chip on Board LEDs is meant to protect the interior of the signaling/illumination device from the environment's elements such as rain, dust, and so on. Such omnidirectional plastic compartment also assists the device's overall durability, and maintains its cylindrical structure.

On top of the signaling/illumination device, lies a LED flashlight that is controlled by an on and off toggle switch. This offers the user with a diverse usage of said device. A police officer, instead of using said device for highlighting a traffic accident in low-light areas, may use the LED flashlight option to conduct an on foot patrol or investigate a scene.

Unlike traditional flares where if a part of the flare is damaged the user is forced to dispose of the entire flare, examples of the present specification are reusable.

Figure 5:
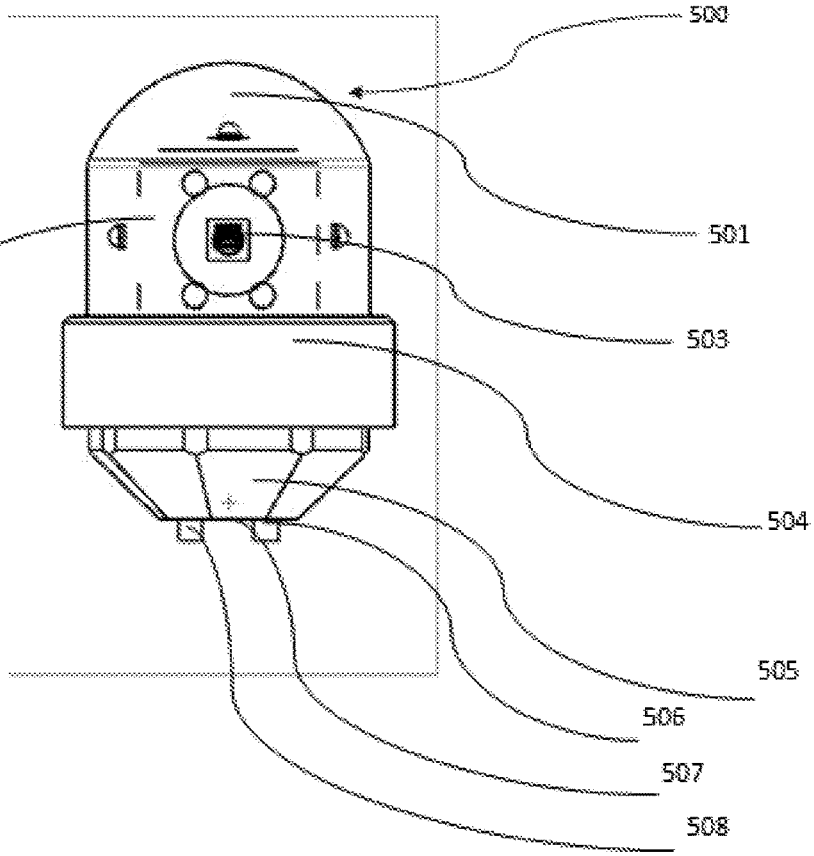
FIG. 5 is an elevation view of an illumination/signaling device in accordance with a second example, including an interchangeable LED bank unit containing all electronics (including LEDs)

FIG. 5 illustrates an interchangeable LED bank unit that contains all the electronics (including the LEDs) of the device 500. The ultra-bright/specialized LEDs 503 called Chip on board LEDs in the interchangeable LED bulb are arranged in a 360 degree configuration set on top of the illumination/signaling device to maximize visibility and effective light distribution with the assistance of the concave lens 501 covering the bank of LED's. This feature saves the user money in long term usage and eventual wear and tear. Unit 502 mounts the LEDs to a structure to conceal the wiring of the LEDs.

The user interface of the device of FIG. 5 comprises of a 6-setting rotary switch 505 (On, Off, Strobe Pattern 1, Strobe Pattern 2, Strobe Pattern 3, and an S.O.S Morse code flash pattern). Removing buttons from the device 500 allows for immediate use during emergency situations, and easy access of all the device's light settings.

Figure 6:
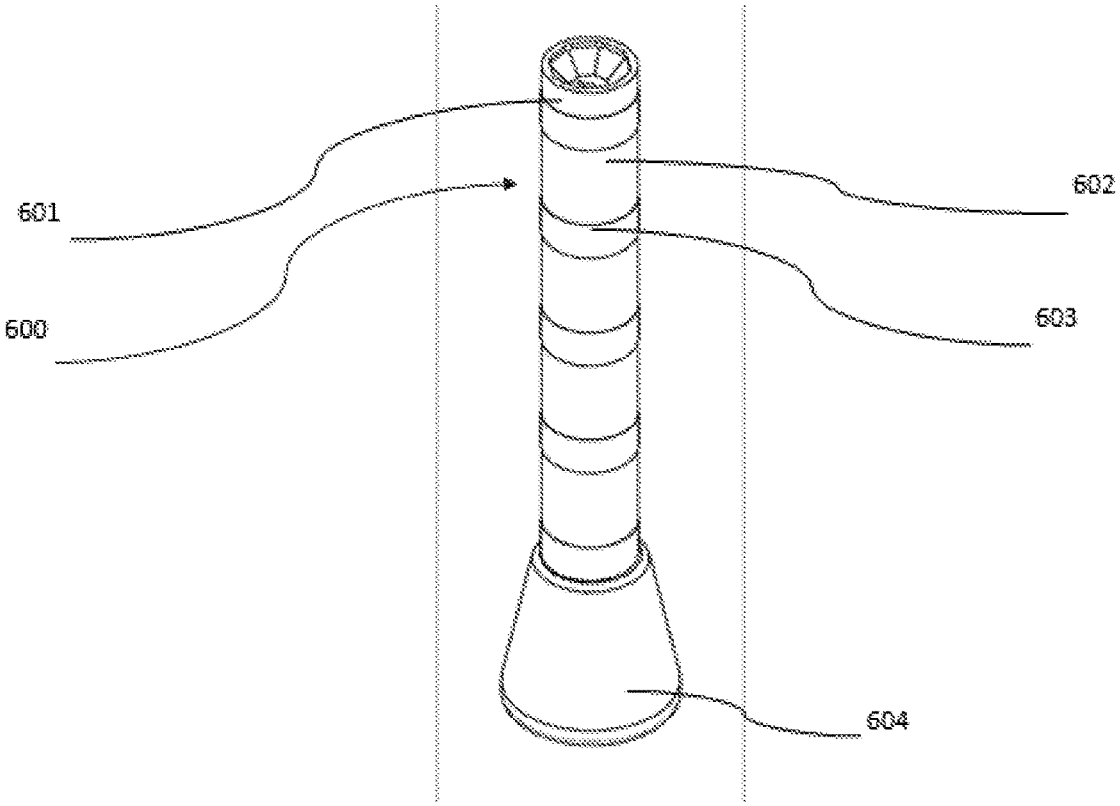
FIG. 6 is a perspective of a polycarbonate/poly-resin outer body for use with the illumination/signaling device of FIG. 5.

FIG. 6 illustrates a polycarbonate/poly-resin outer body 603. The body 603 of the flare also consists of the battery clip inside the casing and cone-shaped cavity 604 near the bottom of FIG. 6. The cone-shaped cavity 604 permits the user the ability of deploying the flare on a pylon in specific applications such as road closures/traffic control, construction sites, and so on. In addition to the cone-shaped cavity, the rim of the cavity is embedded by a magnetic ring that allows the user to set the flare on any metallic surface such as a disables vehicle.

FIG. 6. Illustrates the socket 601 where the bulb of the Chip on board LEDs 105 will connect to the body 603. Socket pin 506 includes the positive terminal connecting the electronics of the device of FIG. 5. The bulb is connected to the battery clip inside the body 603. Socket pins 508 includes the ground terminal connecting the electronics of the device of FIG. 5. The bulb is connected to the battery clip inside the body 603. Socket pin 507 includes the internal rotating pin connected to the rotary switch of the bulb shown in FIG. 5.

The retro-reflective stripes 602 illustrated in FIG. 6 provide the user with increased visibility of the device 100 without the excessive use of the power source of the device 100; allowing the more efficient use of the electrical energy of the device 100 along with a more cost-effective design.

The usage of the LEDs as an alternative to flammable flares allows the user to access light source around a chemical spill and or a nearby flame. The benefit of LEDs are that they are non-combustible and do not produce sparks that can increase the severity of a chemical spill/fire by causing a chain reaction. In chemical spills/flames, the user requires swift solution to notify others of the incident, and the device's user interface of the rotary switch allows quick selection of the various flashing settings the LEDs can display.

The rotary switch found in FIG. 5 allows the user to select multiple flashing patterns that increases the visibility of the device when a car accident occurs. This notifies other drivers and cautions them to steer away from the accident. This is protocol using the device is followed for buses and trucks that are disabled and or in an accident as well. The cone attachment at the bottom of the device would allow the user to deploy the device on a pylon in case of inclement weather that might cover/block the LEDs light; this is done by increasing the height of the device's light source to remain visible.

The Chip on Board LEDs along with the retro reflective stripes surrounding the device allows for increased visibility that can attract the attention of pilots on tarmacs and or runways and direct them to their desired location. The concave lens spreads the light ejected from the LEDs to increase the visibility and spread the reach of attention among more than one pilot/plane.

The Chip on Board LEDs along with the retro reflective stripes surrounding the device allows for increased visibility in order to guide traffic in case of detours, stagnant traffic, guiding motorists away from an accident. This is done by having the user equip the device and wave the device towards a specific direction.

In case of distress on a carrier ship and or boat of any size, the device using its Chip on Board LEDs along with the retro reflective stripes surrounding the device allows for increased visibility can notify nearby aerial vehicles, boats, and or search and rescue teams. The magnetic base of the device allows the user to deploy the device on a metal surface/edge on the boat that allows it to be visible by others while the user can use their efforts on other tasks to relieve the distress.

For promotional events including large sporting events would allow users to use the device to promote the event using the high visibility of the LEDs and obtain larger amount of attention. This use of the device is a marketing/promotional application instead of an emergency scenario.

The replaceable LED bulbs can contain the electronics including the rotary switch to be attachable to any body size of the device for future models. Or the LED bulbs can only contain the set of LEDs that can clip onto the device while having the electronics remain in the body of the device.

The cone attachment (containing a rare earth magnetic ring embedded in the edge of the cone) can become replaceable with other attachments such as a metal stake that can be deployed in the ground, telescopic handle to extend the height of the LED/visibility of the light source, compressed air container to allow the device to be buoyant on water for marine applications.

The housing of the body, the cone attachment and the LED bulb can be comprised of a polycarbonate/poly-resin plastic which provides the user with the high durability factor.

The rotary switch is a waterproofed switch that consists of a rubber gasket that seals out moisture during the rotation of the device.

It will be recognized that while certain features are described in terms of a specific functionality of a device, these descriptions are only illustrative of the broader techniques disclosed herein, and may be modified as required by the particular application. Certain functionality may be rendered unnecessary or optional under certain circumstances. Additionally, certain functionality may be added to the disclosed embodiments. All such variations are considered to be encompassed within the disclosure and claimed herein.

Furthermore, the various aspects, embodiments or features of the described embodiments can be used separately or in any combination.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

The invention claimed is:

1. A portable signaling and illumination device for temporary use in an environment of caution comprising:

a modular and detachable LED bulb comprising Chip on Board LEDs that is replaceable with other modular and detachable LED bulbs comprising a global positioning system; and the modular and detachable LED bulb is enclosed by a plastic housing;

wherein the portable device is grippable and configured to be deployed by handheld means.

2. The portable device of claim 1, wherein the portable device comprises a concave lens mounted atop the LED bulb to distribute light emitted from the Chip on Board LEDs.

3. The portable device of claim 1, wherein the portable device comprises a rotary switch to allow a user to select at least one light and strobe setting.

4. The portable device of claim 1, wherein the modular and detachable LED bulb comprises a positive and negative terminal that connects to an external body comprising a grippable plastic housing that holds the batteries of the portable device.

5. The portable device of claim 1, wherein the portable device comprises a cone-shaped cavity that can be attached to at least one side of a device body; and allows a user to deploy, via a friction fit connection, the portable device on a cone-shaped traffic pylon.

6. The device of claim 1, wherein the portable device comprises a stake that can be attached to at least one side of a portable device body; and the stake allows a user to deploy the portable device onto a surface selected from one of earth, soil, and pavement.

7. A portable signaling and illumination device for temporary use in an environment of caution comprising:

a modular and detachable LED bulb comprising Chip on Board LEDs enclosed in a plastic housing;

a concave lens mounted atop on top the Chip on Board LEDs to distribute light;

a rotary switch to allow a user to select at least one light and strobe setting;

a male-plug connection on a bottom side of the LED bulb permits to the LED bulb to be attached to a grippable plastic housing over a battery cage that holds the batteries of the portable device;

a cone-shaped cavity that can be attached to at least one side of a portable device body that allows a user to deploy the portable device, via a friction fit connection, on a cone-shaped traffic pylon;

a stake that can be attached to at least one side of a portable device body that allows the user to deploy the portable device onto a surface selected from one of: earth, soil, and pavement; and wherein the portable device is grippable and configured to be deployed by handheld means.

* * * * *